US007629937B2

(12) United States Patent
Lier et al.

(10) Patent No.: US 7,629,937 B2
(45) Date of Patent: Dec. 8, 2009

(54) HORN ANTENNA, WAVEGUIDE OR APPARATUS INCLUDING LOW INDEX DIELECTRIC MATERIAL

(75) Inventors: Erik Lier, Newtown, PA (US); Allen Katz, West Windsor, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 12/037,013

(22) Filed: Feb. 25, 2008

(65) Prior Publication Data

US 2009/0213022 A1 Aug. 27, 2009

(51) Int. Cl.
*H01Q 13/00* (2006.01)

(52) U.S. Cl. ..... 343/786; 343/772

(58) Field of Classification Search ..... 343/772, 343/785, 786

See application file for complete search history.

(56) References Cited

U.S. PATENT DOCUMENTS

| | | | | |
|---|---|---|---|---|
| 4,246,584 | A * | 1/1981 | Noerpel | 343/786 |
| 4,447,811 | A * | 5/1984 | Hamid | 343/783 |
| 5,041,840 | A * | 8/1991 | Cipolla et al. | 343/725 |
| 5,214,394 | A * | 5/1993 | Wong | 330/286 |
| 6,879,297 | B2 | 4/2005 | Brown et al. | |
| 6,985,118 | B2 | 1/2006 | Zarro et al. | |
| 6,992,639 | B1 | 1/2006 | Lier | |
| 7,193,578 | B1 | 3/2007 | Harris et al. | |
| 7,379,030 | B1 | 5/2008 | Lier | |
| 2001/0020920 | A1 | 9/2001 | Shigihara | |
| 2003/0210197 | A1 | 11/2003 | Cencich et al. | |
| 2005/0007289 | A1 | 1/2005 | Zarro et al. | |
| 2005/0107125 | A1 * | 5/2005 | Gilbert | 455/562.1 |
| 2006/0092080 | A1 * | 5/2006 | Lee | 343/700 MS |

OTHER PUBLICATIONS

Lier et al., "A New Class of Dielectric-Loaded Hybrid-Mode Horn Antennas with Selective Gain: Design and Analysis by Single Mode Model and Method of Moments," Jan. 2005, pp. 125-138, vol. 53, No. 1, IEEE Transactions on Antennas and Propagation.

* cited by examiner

*Primary Examiner*—HoangAnh T Le
(74) *Attorney, Agent, or Firm*—McDermott Will & Emery LLP

(57) ABSTRACT

A horn antenna includes a conducting horn having an inner wall and a first dielectric layer lining substantially the entire inner wall of the conducting horn. The first dielectric layer includes a metamaterial having a dielectric constant of greater than 0 and less than 1. The horn antenna may further include a dielectric core abutting at least a portion of the first dielectric layer. In one aspect, the dielectric core includes a fluid. A waveguide and a power combiner assembly, each including a metamaterial, are also disclosed.

20 Claims, 7 Drawing Sheets

HORN ANTENNA, WAVEGUIDE OR APPARATUS INCLUDING LOW INDEX DIELECTRIC MATERIAL

FIELD

The present invention generally relates to antennas and communication devices, and in particular, relates to horn antennas, waveguides and apparatus including low index dielectric material.

BACKGROUND

Maximum directivity from a horn antenna may be obtained by uniform amplitude and phase distribution over the horn aperture. Such horns are denoted as "hard" horns.

Exemplary hard horns may include one having longitudinal conducting strips on a dielectric wall lining, and the other having longitudinal corrugations filled with dielectric material. These horns work for various aperture sizes, and have increasing aperture efficiency for increasing size as the power in the wall area relative to the total power decreases.

Dual mode and multimode horns like the Box horn can also provide high aperture efficiency, but they have a relatively narrow bandwidth, in particular for circular polarization. Higher than 100% aperture efficiency relative to the physical aperture may be achieved for endfire horns. However, these endfire horns also have a small intrinsic bandwidth and may be less mechanically robust.

Linearly polarized horn antennas may exist with high aperture efficiency at the design frequency, large bandwidth and low cross-polarization. However, these as well as the other non hybrid-mode horns only work for limited aperture size, typically under 1.5 or 2λ.

SUMMARY

The present invention provides a new class of hybrid-mode horn antennas. The present invention facilitates the design of boundary conditions between soft and hard, supporting modes under balanced hybrid condition with uniform as well as tapered aperture distribution. According to one aspect of the disclosure, hybrid-mode horn antennas of the present invention include a low index dielectric material such as a metamaterial having a dielectric constant of greater than zero and less than one. The use of such metamaterial allows the core of the hybrid-mode horn antennas to comprise a fluid dielectric, rather than a solid dielectric, as is traditionally used.

In accordance with one aspect of the present invention, a horn antenna comprises a conducting horn having an inner wall and a first dielectric layer lining substantially the entire inner wall of the conducting horn. The first dielectric layer comprises a metamaterial having a dielectric constant of greater than 0 and less than 1.

According to another aspect of the present invention, a waveguide comprises an outer surface defining a waveguide cavity, an inner surface positioned within the waveguide cavity, and a first dielectric layer lining substantially the entire inner surface of the waveguide cavity. The first dielectric layer comprises a metamaterial having a dielectric constant of greater than 0 and less than 1.

According to yet another aspect of the present invention, a power combiner assembly comprises a plurality of power amplifiers and a conducting horn. The conducting horn has an inner wall and a dielectric layer lining substantially the entire inner wall. The dielectric layer includes a metamaterial having a dielectric constant of greater than 0 and less than 1. The plurality of power amplifiers may be configured to provide power to the conducting horn and wherein the conducting horn may be configured to combine the power from the plurality of power amplifiers into a single power transmission.

Additional features and advantages of the invention will be set forth in the description below, and in part will be apparent from the description, or may be learned by practice of the invention. The objectives and other advantages of the invention will be realized and attained by the structure particularly pointed out in the written description and claims hereof as well as the appended drawings.

It may be understood that both the foregoing general description and the following detailed description are exemplary and explanatory and are intended to provide further explanation of the invention as claimed.

BRIEF DESCRIPTION OF THE DRAWINGS

Various aspects of a system of the present invention are illustrated by way of example, and not by way of limitation, in the accompanying drawings, wherein.

DETAILED DESCRIPTION

Figure 1:
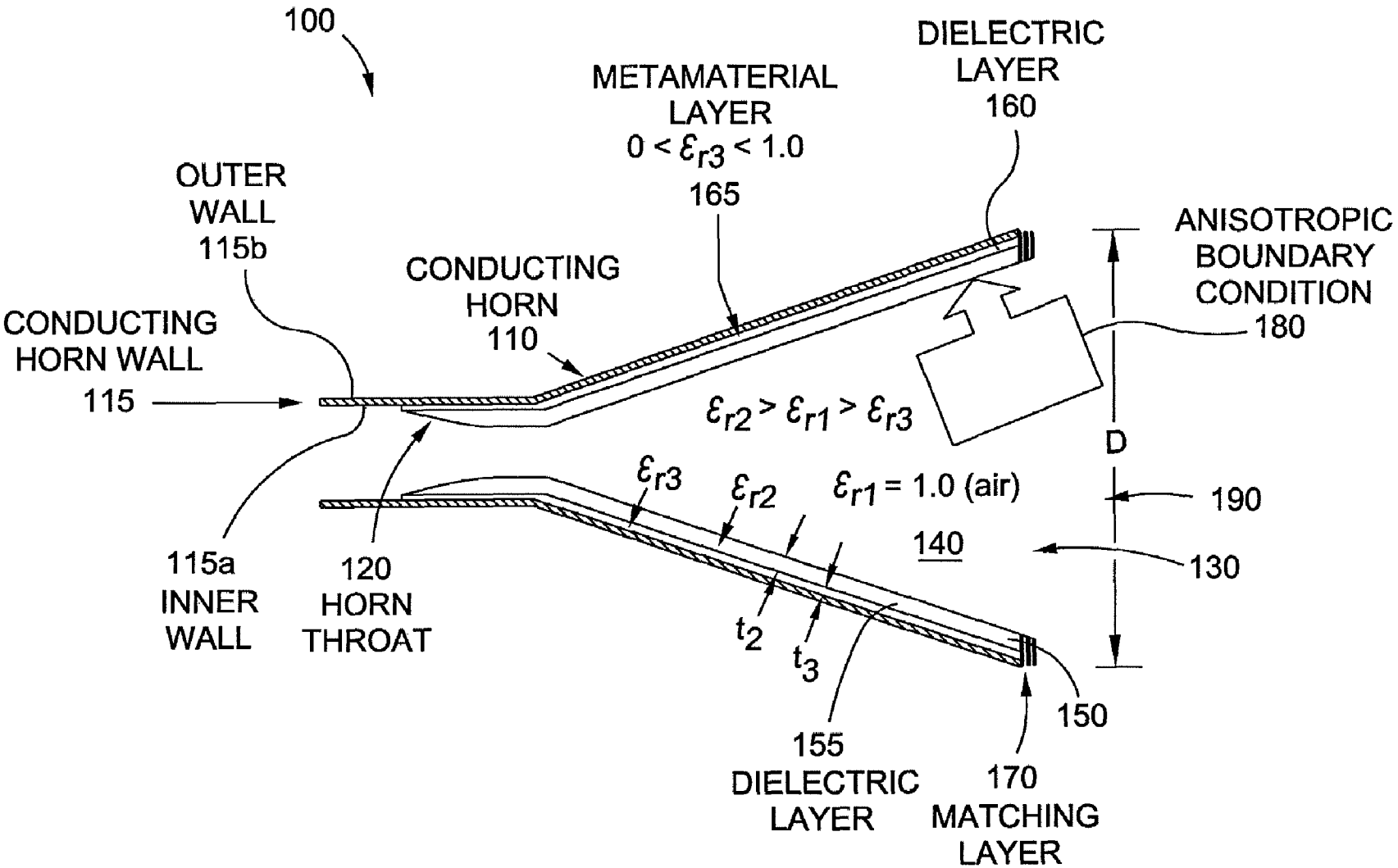
FIG. 1 illustrates an exemplary horn antenna in accordance with one aspect of the present invention.

In the following detailed description, numerous specific details are set forth to provide a full understanding of the present invention. It will be obvious, however, to one ordinarily skilled in the art that the present invention may be practiced without some of these specific details. In other instances, well-known structures and techniques have not been shown in detail to avoid obscuring concepts of the present invention.

Reference will now be made in detail to aspects of the subject technology, examples of which are illustrated in the accompanying drawings, wherein like reference numerals refer to like elements throughout.

In one aspect, a new and mechanically simple dielectric-loaded hybrid-mode horn is presented. As an example, a dielectric-loaded horn includes a horn that has a dielectric material disposed within the horn. In alternative aspects of the present invention, the horn satisfies hard boundary conditions, soft boundary conditions, or boundaries between soft and hard under balanced hybrid conditions. Like other hybrid-mode horns, the present design is not limited in aperture size.

For example, in one aspect of the present invention, the horns can support the transverse electromagnetic (TEM) mode, and apply to linear as well as circular polarization. They are characterized with hard boundary impedances:

$$Z_z=-E_z/H_x=0 \text{ and } Z_x=E_x/H_{z=\infty} \quad (1)$$

or soft boundary impedances:

$$Z_z=E_z/H_x=\infty \text{ and } Z_x=E_x/H_z=0 \quad (2)$$

meeting the balanced hybrid condition:

$$Z_zZ_x=\eta_0^2 \quad (3)$$

where $\eta_0$ is the free space wave impedance and the coordinates z and x are defined as longitudinal with and transverse to the direction of the wave, respectively. In one aspect, both hard and soft horns may be constructed which satisfy the balanced hybrid condition (3). Further, both hard and soft horns presented provide simultaneous dual polarization, i.e., dual linear or dual circular polarization.

The present horns may be used in the cluster feed for multibeam reflector antennas to reduce spillover loss across the reflector edge. Such horns may also be useful in single feed reflector antennas with size limitation, in quasi-optical amplifier arrays, and in limited scan array antennas.

FIG. 1 illustrates an exemplary horn antenna 100 in accordance with one aspect of the present invention. As shown in FIG. 1, horn antenna 100 represents a hard horn and includes a conducting horn 110 having a conducting horn wall 115. Conducting horn wall 115 may include an inner wall 115*a* and an outer wall 115*b*. Conducting horn wall 115 extends outwardly from a horn throat 120 to define an aperture 190 having a diameter D. While referred to as "diameter," it will be appreciated by those skilled in the art that conducting horn 110 may have a variety of shapes, and that aperture 190 may be circular, elliptical, rectangular, hexagonal, square, or some other configuration all within the scope of the present invention. In one aspect, conducting horn 110 has anisotropic wall impedance according to equations (1) and (2) and shown by anisotropic boundary condition 180. Furthermore, anisotropic boundary condition 180 can be designed to meet the balanced hybrid condition in equation (3) in the range from hard to soft boundary conditions.

The space within horn 110 may be at least partially filled with a dielectric core 130. In one aspect, dielectric core 130 includes an inner core portion 140 and an outer core portion 150. In one aspect, inner core portion 140 comprises a fluid such as an inert gas, air, or the like. In some aspects, inner core portion 140 comprises a vacuum. In one aspect, outer core portion 150 comprises polystyrene, polyethylene, teflon, or the like. It will be appreciated by those skilled in the art that alternative materials may also be used within the scope of the present invention.

In one aspect, dielectric core 130 may be separated from horn wall 115 by a first dielectric layer 160 which may help correctly position core 130. First dielectric layer 160 comprises a metamaterial and lines a portion or all of horn wall 115. In some aspects, first dielectric layer 160 comprises a metamaterial layer 165.

Metamaterial layer 165 comprises a metamaterial having a low refractive index, i.e., between zero and one. Refractive index is usually given the symbol n:

$$n=\sqrt{(\in_r\mu_r)} \quad (4)$$

where $\in_r$ is the material's relative permittivity (or dielectric constant) and $\mu_r$ is its relative permeability. For most materials, $\in_r$ is very close to one, therefore n is approximately $\sqrt{\in_r}$.

By definition a vacuum has a dielectric constant of one and most materials have a dielectric constant of greater than one. Some metamaterials have a negative refractive index, e.g., have a negative dielectric constant or a negative relative permeability and are known as single-negative (SNG) media. Additionally, some metamaterials have a positive refractive index but have a negative dielectric constant and a negative relative permeability; these metamaterials are known as double-negative (DNG) media. It may be generally understood that metamaterials possess artificial properties, e.g. not occurring in nature, such as negative refraction.

However, to date not much work has been done on metamaterials having a dielectric constant (relative permittivity) near zero. According to one aspect of the present invention, metamaterial layer 165 comprises a metamaterial having a dielectric constant of greater than zero and less than one. In some aspects, metamaterial layer 165 comprises a metamaterial having a permeability of approximately one. In these aspects, metamaterial layer 165 has a positive refractive index that approaches zero. In other aspects, metamaterial layer 165 comprises a metamaterial having a permeability of greater than one. In these aspects, metamaterial layer 165 has a positive refractive index that approaches one.

In some aspects, outer core portion 150 comprises a second dielectric layer 155. It may be understood that in one aspect, first dielectric layer 160, second dielectric layer 155 and inner core portion 140 have different dielectric constants. In some aspects, second dielectric layer 155 has a higher dielectric constant than does inner core portion 140 ($\in_{r2}>\in_{r1}$). In some aspects, inner core portion 140 has a higher dielectric constant than does first dielectric layer 160 ($\in_{r1}>\in_{r3}$). It should be appreciated that by using a metamaterial having a dielectric constant of greater than zero and less than one in first dielectric layer 160, inner core portion 140 may comprise a fluid such as air.

In one aspect, first dielectric layer 160 has a generally uniform thickness $t_3$ and extends from about throat 120 to aperture 190. In one aspect, outer portion of core 150 may have a generally uniform thickness $t_2$. As is known by those skilled in the art, $t_2$ and $t_3$ depend on the frequency of incoming signals. Therefore, both $t_2$ and $t_3$ may be constructed in accordance with thicknesses used generally for conducting horns. For example, in one aspect, thickness $t_2$ and/or $t_3$ may vary between horn throat 120 and aperture 190. In some aspects, one or both thickness $t_2$, $t_3$ may be greater near throat 120 than aperture 190, or may be less near throat 120 than aperture 190.

In one aspect, horn throat 120 may be matched to convert the incident field into a field with approximately the same cross-sectional distribution as may be required by aperture 190. This may be accomplished, for example, by the physical arrangement of inner core portion 140 and outer core portion 150. In this manner, the desired mode for conducting horn 110 may be excited. Furthermore, this arrangement may help to reduce return loss or the reflection of energy in throat 120.

Conducting horn 110 may further include one or more matching layers 170 between first dielectric layer 160, second dielectric layer 155 and free space in aperture 190. Matching layers 170 may include, for example, one or more dielectric materials coupled to core portion 140 and/or 150 near aperture 190. In one aspect, matching layer 170 has a dielectric constant between the dielectric constant of core portion 140, 150 to which it is coupled. In one aspect, matching layer 170 includes a plurality of spaced apart rings or holes. The spaced apart rings or holes (not shown) may have a variety of shapes and may be formed in symmetrical or non-symmetrical patterns. In one aspect, the holes may be formed in the aperture portion of core portions 140 and/or 150 to create a matching layer portion of core 130. In one aspect, the holes and/or rings may be formed to have depth of about one-quarter wavelength ($\frac{1}{4}\lambda$) of the dielectric material in which they are formed. In one aspect, outer portion 150 may include a corrugated matching layer (not shown) at aperture 190.

Conducting horn 110 of the present invention may have different cross-sections, including circular, elliptical, rectangular, hexagonal, square, or the like for circular or linear polarization. Referring to FIG. 7A, a hexagonal cross-section 700 is shown having an hexagonal aperture 710. In accordance with one aspect of the present invention, cross-section 710 includes a fluid dielectric core 720, a metamaterial layer 730, and a conducting horn wall 740.

Figure 7B:
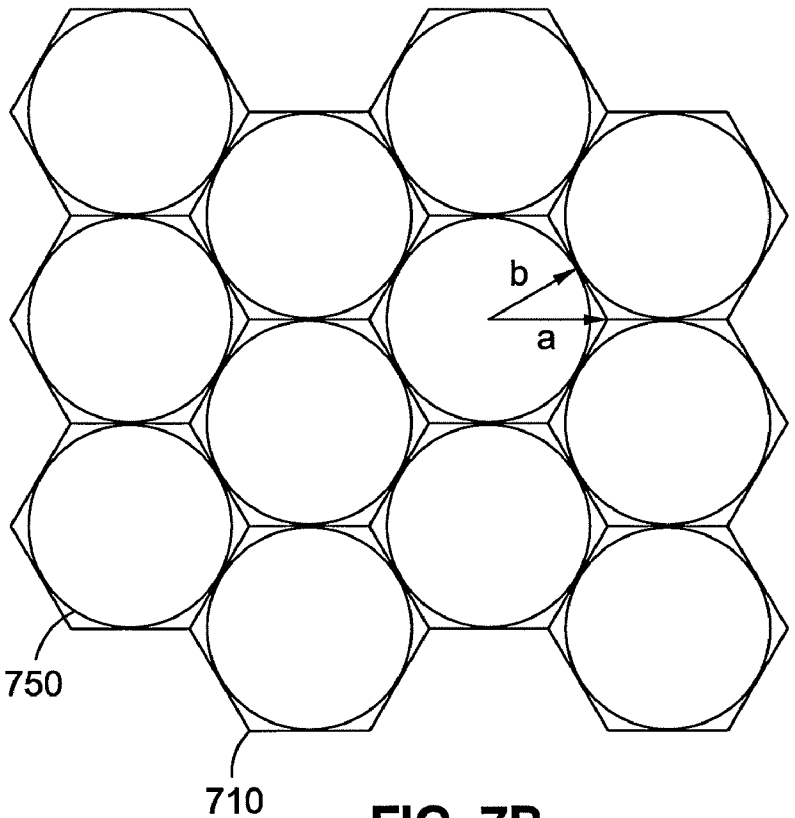
FIGS. 7A and 7B illustrate exemplary horn cross-sections for circular or linear polarization in accordance with one aspect of the present invention.
Figure 7A:
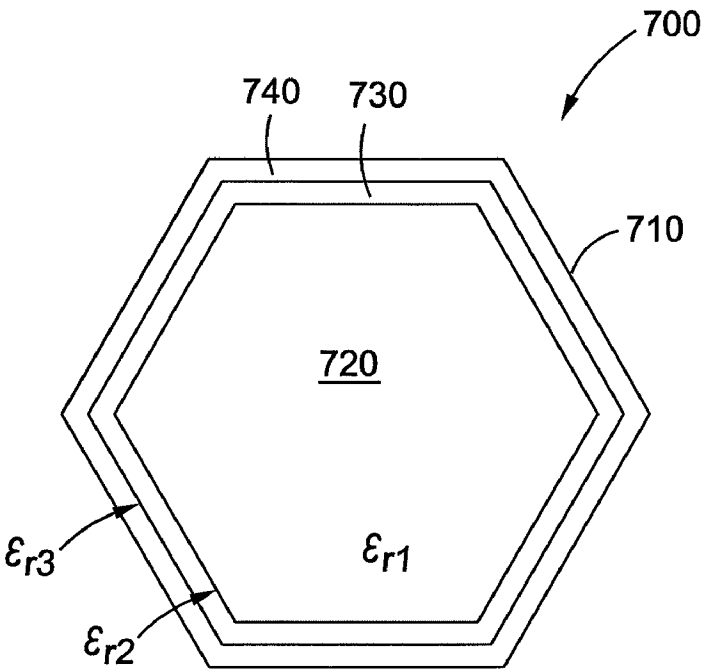

Referring briefly to FIG. 7B, a plurality of circular apertures 750 having a radii b are compared to a plurality of hexagonal apertures 710 having radii a. In this example, radius a is larger than radius b; consequently a conducting horn 110 having a hexagonal aperture 710 may have an array aperture efficiency of approximately 0.4 dB greater than a conducting horn 110 having a circular aperture.

Figure 2:
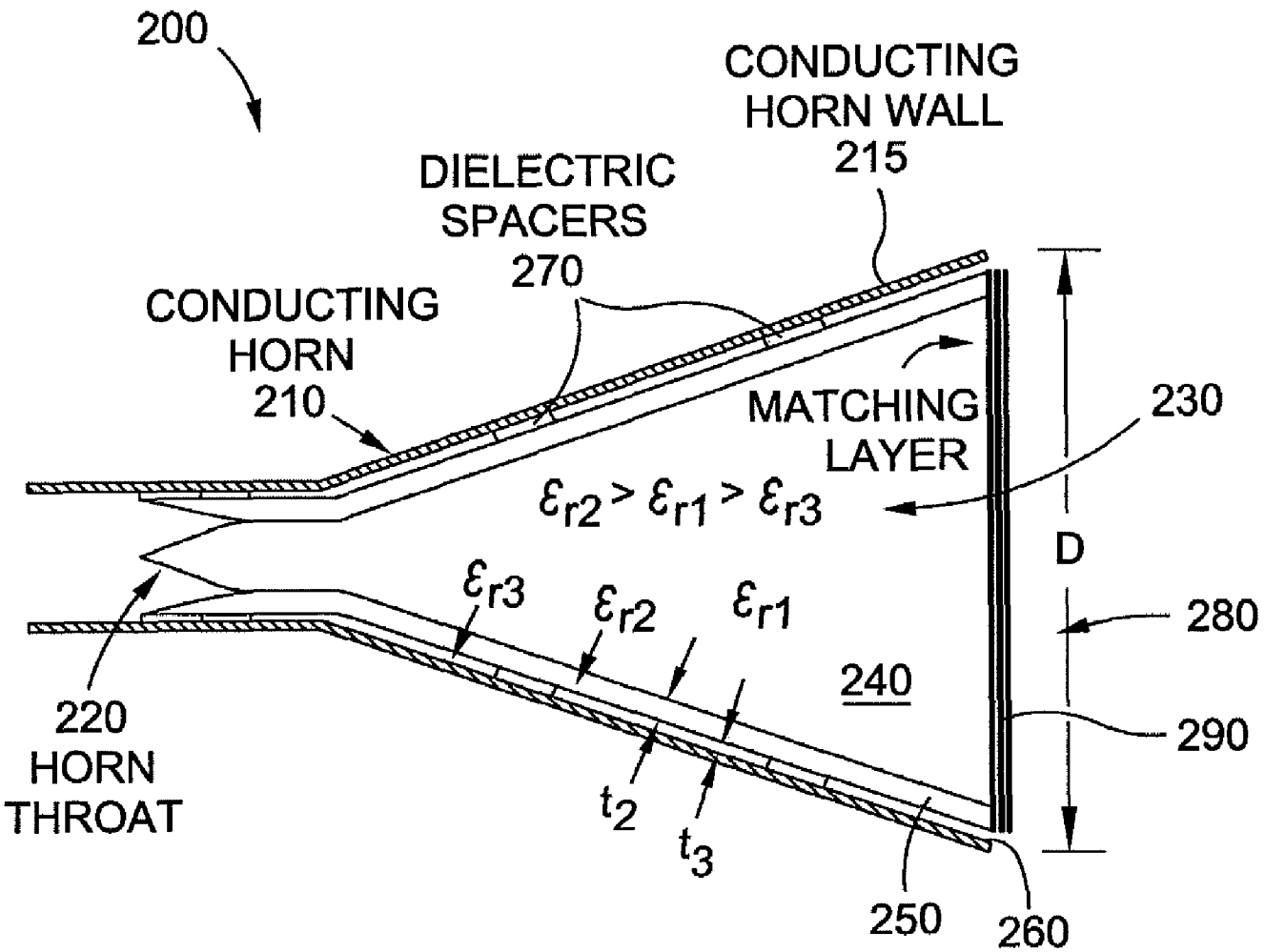
FIG. 2 illustrates another exemplary horn antenna.

Referring now to FIG. 2, an exemplary hard horn antenna 200 is illustrated. Horn antenna 200 includes a conducting horn 210 having a conducting horn wall 215. Conducting horn wall 215 extends outwardly from a horn throat 220 to define an aperture 280 having a diameter D.

The space within horn 210 may be at least partially filled with a dielectric core 230. In one aspect, dielectric core 230 includes an inner core portion 240 and an outer core portion 250. In one aspect, inner core portion 240 comprises a solid such as foam, honeycomb, or the like.

In one aspect, dielectric core 230 may be separated from wall 215 by a gap 260. In one aspect, gap 260 may be filled or at least partially filled with air. Alternatively, gap 260 may comprise a vacuum. In one aspect, a spacer or spacers 270 may be used to position dielectric core 230 away from horn wall 215. In some aspects, spacers 270 completely fill gap 260, defining a dielectric layer lining some or all of horn wall 215.

In one aspect, outer core portion 250 has a higher dielectric constant than does inner core portion 240. In one aspect, inner core portion 240 has a higher dielectric constant than does gap 260.

Gap 160 may have a generally uniform thickness $t_3$ and extends from about throat 220 to aperture 280. In one aspect, outer portion of core 250 has a generally uniform thickness $t_2$. As is known by those skilled in the art, $t_2$ and $t_3$ depend on the frequency of incoming signals. Therefore, both $t_2$ and $t_3$ may be constructed in accordance with thicknesses used generally for conducting horns.

Throat 220 of conducting horn 210 may be matched to convert the incident filed into a field with approximately the same cross-sectional distribution as may be required in aperture 280. Additionally, conducting horn 210 may include one or more matching layers 290 between dielectric and free space in aperture 280.

Dielectric-loaded horns constructed in accordance with aspects of the invention offer improved antenna performance, e.g., larger intrinsic bandwidth, compared to conventional antennas. Horn antennas constructed in accordance with aspects described for hard horn antenna 100 offer additional benefits. For example, utilizing a metamaterial as a dielectric layer allows a horn antenna 100 to be constructed which has a fluid core. Consequently, a solid core such as used in horn antenna 200 may be eliminated. Additionally, any losses and electrostatic discharge (ESD) due to such solid core may be eliminated.

Figure 3:
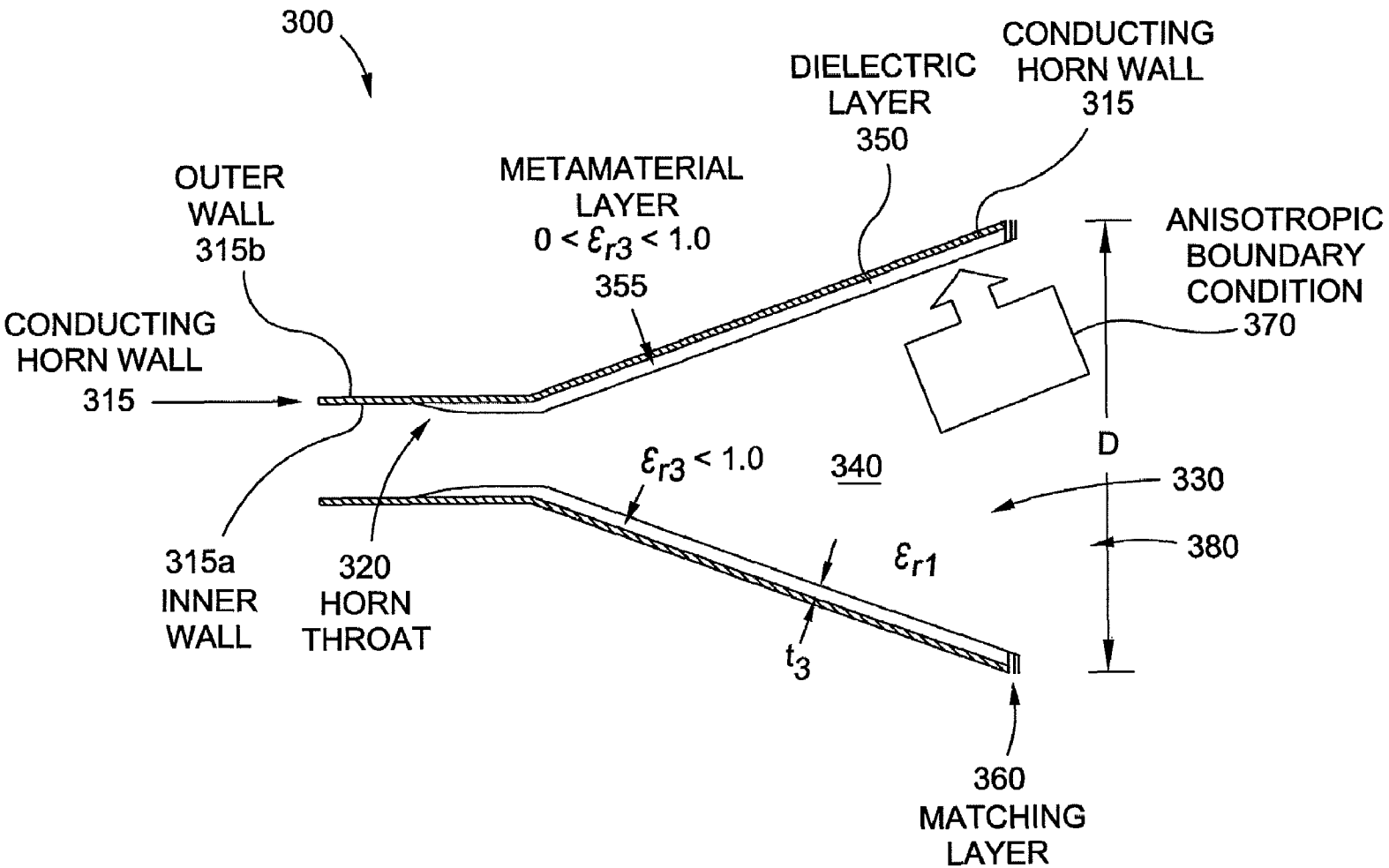
FIG. 3 illustrates an exemplary horn antenna in accordance with one aspect of the present invention.

Referring now to FIG. 3, an exemplary horn antenna 300 in accordance with one aspect of the present invention is shown. As shown in FIG. 3, horn antenna 300 represents a soft horn and includes a conducting horn 310 having a conducting horn wall 315. Conducting horn wall 315 may include an inner wall 315*a* and an outer wall 315*b*. Conducting horn wall 315 extends outwardly from a horn throat 320 to define an aperture 380 having a diameter D. In one aspect, conducting horn 310 has anisotropic wall impedance according to equations (1) and (2) and shown by anisotropic boundary condition 370.

The space within horn 310 may be at least partially filled with a dielectric core 330. In one aspect, dielectric core 330 includes an inner core portion 340 which comprises a fluid such as an inert gas, air, or the like. In some aspects, inner core portion 340 comprises a vacuum.

In one aspect, dielectric core 330 may be separated from horn wall 315 by a first dielectric layer 350 and may help correctly position core 330. First dielectric layer 350 comprises a metamaterial and lines a portion or all of horn wall 315. In some aspects, first dielectric layer 350 comprises a metamaterial layer 355. According to one aspect of the present invention, metamaterial layer 355 comprises a metamaterial having a dielectric constant of greater than zero and less than one.

In some aspects, first dielectric layer 350 has a lower dielectric constant than inner core portion 340 ($\in_{r3}<\in_{r1}$). It should be appreciated that by using a metamaterial having a dielectric constant of greater than zero and less than one in first dielectric layer 350, inner core portion 340 may comprise a fluid such as air.

In one aspect, first dielectric layer 350 may have a generally uniform thickness $t_3$ and extends from about throat 320 to aperture 380. Additionally, $t_3$ may be constructed in accordance with thicknesses used generally for conducting horns.

Horn throat 320 may be matched to convert the incident field into a field with approximately the same cross-sectional distribution as may be required by aperture 380. Furthermore, conducting horn 310 may also include one or more matching layers 360 between first dielectric layer 350 and free space in aperture 380.

Figure 4:
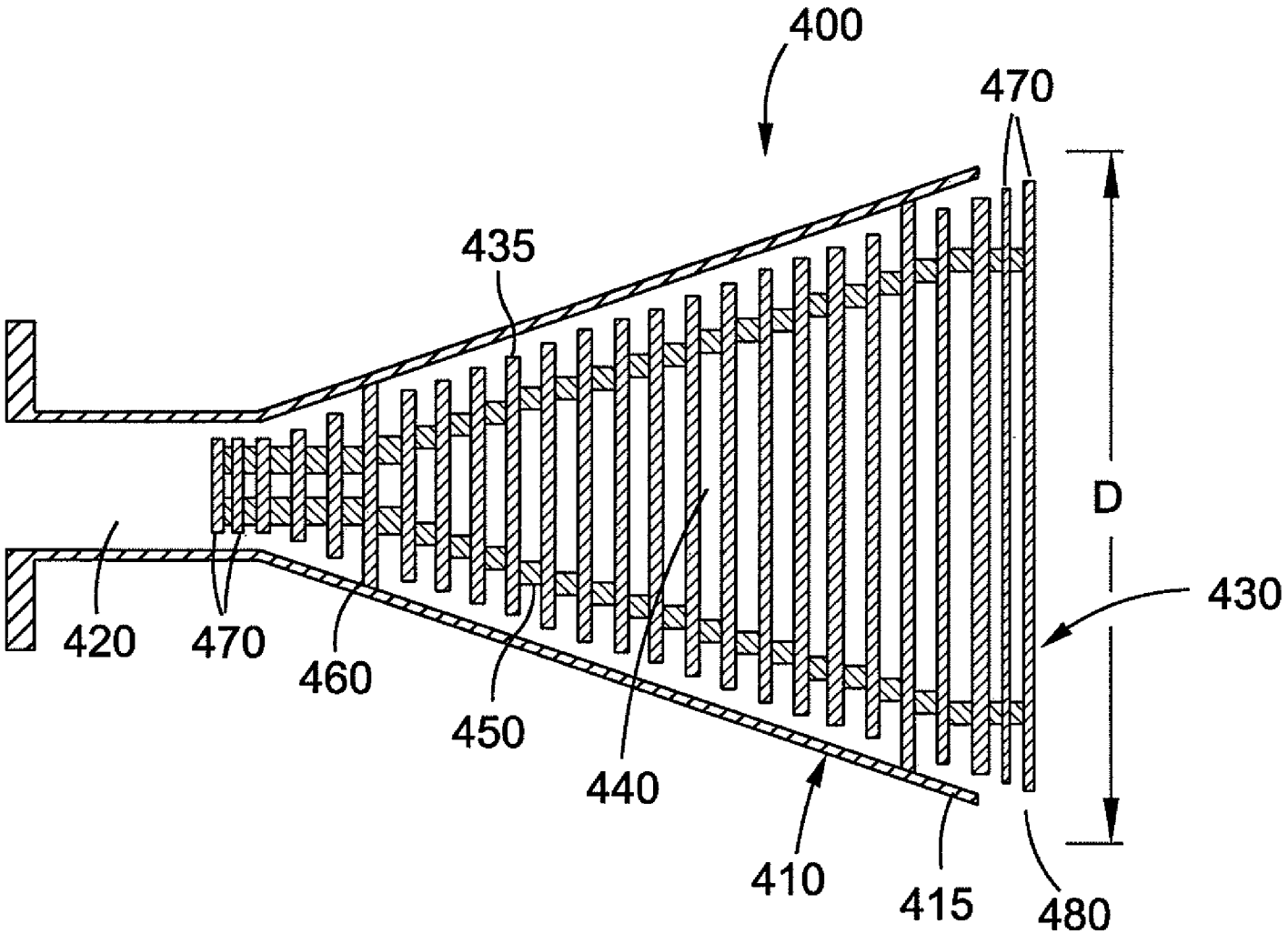
FIG. 4 illustrates yet another exemplary horn antenna.

Referring now to FIG. 4, an exemplary soft horn antenna 400 is illustrated. Horn antenna 400 includes a conducting horn 410 having a conducting horn wall 415. Conducting horn wall 415 extends outwardly from a horn throat 420 to define an aperture 480 having a diameter D.

The space within horn 410 may be at least partially filled with a dielectric core 430. In one aspect, dielectric core 430 includes an inner core portion 440 which comprises a plurality of solid dielectric discs 435. Dielectric disks 435 may be constructed from foam, honeycomb, or the like. In one aspect, dielectric disks 435 may be separated from each other by spacers 450. In one aspect, the plurality of solid dielectric disks 435 may be positioned within inner core portion 440 by spacers 460 abutting conducting horn wall 415. Additionally, horn 410 may include one or more matching layers 470 between dielectric and free space in aperture 480. In one aspect, matching layer 470 comprises two dielectric disks 435.

Horn antennas constructed in accordance with aspects described for soft horn antenna 300 offer additional benefits over horn antenna 400. For example, utilizing a metamaterial as a dielectric layer allows a horn antenna to be constructed which has a fluid core. Consequently, a core comprising solid dielectric disks such as used in horn antenna 400 may be eliminated. Additionally, any losses and electrostatic discharge (ESD) due to such solid dielectric disks may be eliminated.

Figure 5:
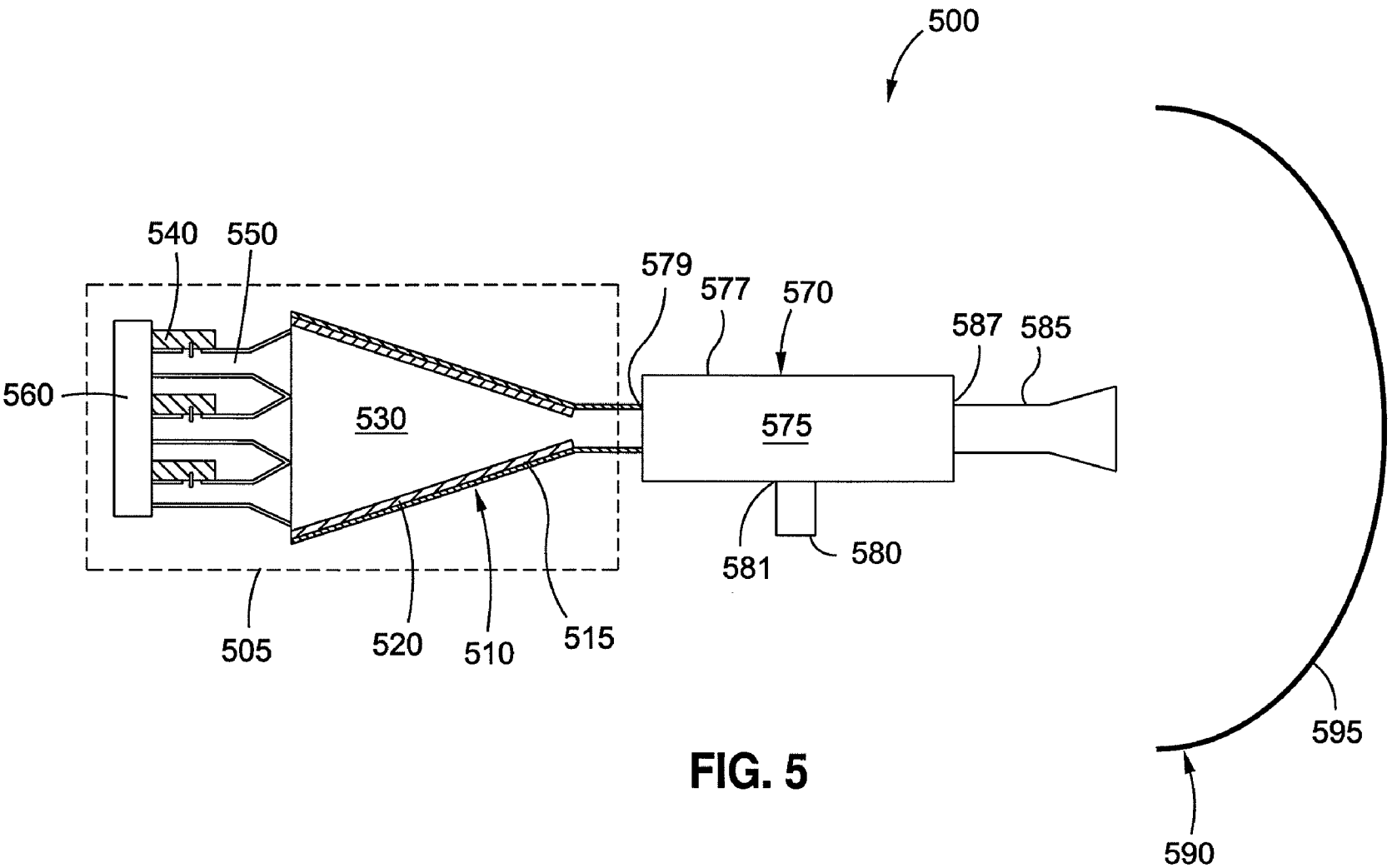
FIG. 5 illustrates an exemplary power combiner assembly in accordance with one aspect of the present invention.

Referring now to FIG. 5, an exemplary power combiner assembly 500 in accordance with one aspect of the present invention is shown. Power combiner assembly 500 includes a power combiner system 505. In one aspect, power combiner assembly 500 also includes a multiplexer 570 and a reflector 590 such as a reflective dish 595.

Power combiner system 505 includes a horn antenna 510 in communication with a plurality of power amplifiers 540. In one aspect, power amplifiers 540 comprise solid state power amplifiers (SSPA). In some aspects, power amplifiers 540 may be in communication with a heat dissipation device 560 such as a heat spreader. In one aspect, power amplifiers 540 may be operated at their maximum operating point, thereby providing maximum power to horn antenna 510. For example, power amplifiers 540 may output signals operating in the radio frequency (RF) range. In one aspect, the RF range includes frequencies from approximately 3 Hz to 300 GHz. In another aspect, the RF range includes frequencies from approximately 1 GHz to 100 GHz. These are exemplary ranges, and the subject technology is not limited to these exemplary ranges.

The plurality of power amplifiers 540 may provide power to horn antenna 510 via known transmission means such as a waveguide or antenna element 550. In one aspect, an open-ended waveguide may be associated with each of the plurality of power amplifiers 540. In one aspect, a microstrip antenna element may be associated with each of the plurality of power amplifiers 540.

In one aspect, horn antenna 510 includes a conducting horn wall 515, an inner core portion 530, and a first dielectric layer 520 disposed in between horn wall 515 and inner core portion 530. In one aspect, inner core portion 530 comprises a fluid such as an inert gas or air. In one aspect, first dielectric layer 520 comprises a metamaterial having a dielectric constant of greater than zero and less than one.

In one aspect, multiplexer 570 comprises a diplexer 575. Diplexer 575 includes an enclosure 577 having a common port 587, a transmit input port 579 and a receive output port 581. In some aspects, diplexer 575 further includes a plurality of filters for filtering transmitted and received signals. One of ordinary skill in the art would be familiar with the operation of a diplexer 575, so further discussion is not necessary. In one aspect, the main port 579 may be configured to receive power signals from horn antenna 520.

In one aspect, common port 587 may be coupled to a feed horn 585 and may be configured to direct and guide the RF signal to reflector 590. In one aspect, power combiner assembly 500 may be mounted to a reflective dish 595 for receiving and/or transmitting the RF signal. As an example, reflective dish 595 may comprise a satellite dish.

A benefit associated with power combiner assembly 500 is that power combiner assembly 500 allows power amplifiers 540 to be driven at their maximum operating point, thereby enabling maximum spatial power combining efficiency. Additionally, power combiner assembly 500 offers simultaneous linear or circular polarization.

Figure 6:
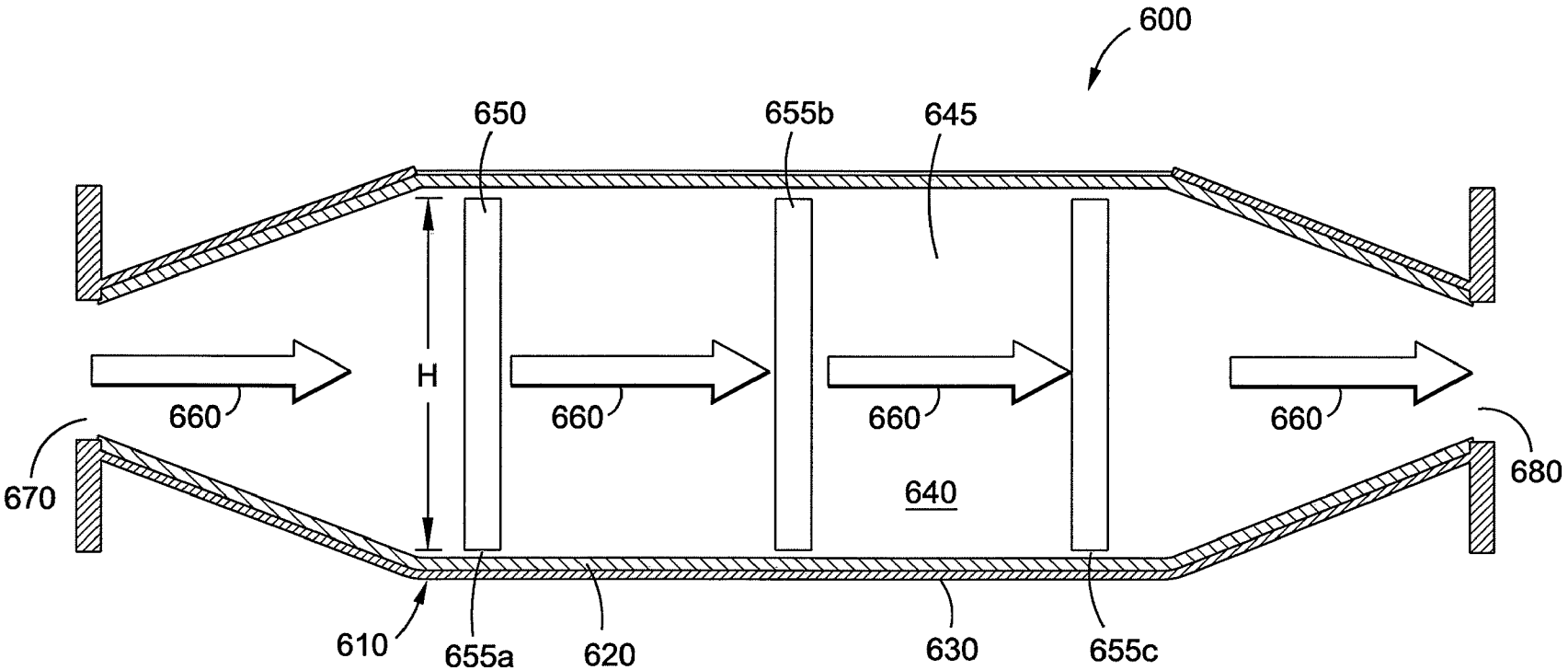
FIG. 6 illustrates an exemplary waveguide assembly in accordance with one aspect of the present invention.

Referring now to FIG. 6, an exemplary waveguide 600 in accordance with one aspect of the present invention is shown. Waveguide 600 includes an outer surface 610, an inner surface 630, and an inner cavity 640. Inner cavity 640 is at least partially defined by outer surface 610.

Waveguide 600 further includes a first aperture 670 and a second aperture 680 located at opposite ends of waveguide 600 with inner cavity 640 located therein between the apertures 670, 680. It should be understood that first aperture 670 may be configured to receive RF signals into waveguide 600 and that second aperture 680 may be configured to transmit RF signals out of waveguide 600.

In one aspect, the portion of waveguide 600 surrounding first aperture 670 may be tapered so that inner cavity 640 decreases in size as it approaches the first aperture 670. This tapering of waveguide 600 enables first aperture 670 to operate as a power divider because the power of a signal received by aperture 670 may be spread out over height H of inner cavity 640. In one aspect, the portion of waveguide 600 surrounding second aperture 680 may be tapered so that inner cavity 640 decreases in size as it approaches second aperture 680. This tapering of waveguide 600 enables second aperture 680 to operate as a power combiner because the power of the signal that propagates through inner cavity 640 may be condensed when it exits through second aperture 680.

In one aspect, a first dielectric layer 620 may be disposed between inner surface 630 and inner cavity 640. In one aspect, first dielectric layer 620 comprises a metamaterial having a dielectric constant of greater than zero and less than one.

In one aspect, inner cavity 640 includes a fluid portion 645 such as gas or air and a solid portion 650. In one aspect, solid portion 650 comprises a plurality of power amplifiers 655. In one aspect, the plurality of power amplifiers 655 may be arranged parallel to each other. In one aspect, the plurality of power amplifiers 655 may be arranged so that they are substantially perpendicular to inner surface 630.

In one aspect, the plurality of power amplifiers 655 may be arranged in an array such that there are amplification stages. As shown in FIG. 6, there are three such amplification stages. For example, in one aspect an RF signal 660 enters waveguide 600 through aperture 670 and illuminates power amplifier 655*a*. Power amplifier 655*a* amplifies signal 660 a first time. Thereafter, signal 660 illuminates power amplifier 655*b*, which in turn amplifies the signal 660 a second time. Thereafter, signal 660 illuminates power amplifier 655*c*, which in turn amplifies the signal 660 a third time before it exits waveguide 600 through aperture 680.

A benefit realized by waveguide 600 is that RF signal may be amplified by utilizing amplification stages. Additionally, because the design of waveguide 600 may be relatively simple, any number of amplification stages may be easily added.

The description of the invention is provided to enable any person skilled in the art to practice the various arrangements described herein. While the present invention has been particularly described with reference to the various figures and configurations, it should be understood that these are for illustration purposes only and should not be taken as limiting the scope of the invention. There may be many other ways to implement the invention. Various functions and elements described herein may be partitioned differently from those shown without departing from the scope of the invention. Various modifications to these configurations will be readily apparent to those skilled in the art, and generic principles defined herein may be applied to other configurations. Thus, many changes and modifications may be made to the invention, by one having ordinary skill in the art, without departing from the scope of the invention.

Unless specifically stated otherwise, the term "some" refers to one or more. A reference to an element in the singular is not intended to mean "one and only one" unless specifically stated, but rather "one or more."

Terms such as "top," "bottom," "into," "out of" and the like as used in this disclosure should be understood as referring to an arbitrary frame of reference, rather than to the ordinary gravitational frame of reference. Thus, for example, a top surface and a bottom surface may extend upwardly, downwardly, diagonally, or horizontally in a gravitational frame of reference.

All structural and functional equivalents to the elements of the various configurations described throughout this disclosure that are known or later come to be known to those of ordinary skill in the art are expressly incorporated herein by reference and intended to be encompassed by the invention.

Moreover, nothing disclosed herein is intended to be dedicated to the public regardless of whether such disclosure is explicitly recited in the above description. No claim element is to be construed under the provisions of 35 U.S.C. §112, sixth paragraph, unless the element is expressly recited using the phrase "means for" or, in the case of a method claim, the element is recited using the phrase "step for."

It is understood that the specific order or hierarchy of steps in the processes disclosed is an illustration of exemplary approaches. Based upon design preferences, it is understood that the specific order or hierarchy of steps in the processes may be rearranged. Any accompanying method claims present elements of the various steps in a sample order, which may or may not occur sequentially, and are not meant to be limited to the specific order or hierarchy presented. Furthermore, some of the steps may be performed simultaneously.

What is claimed is:

1. A horn antenna comprising:

a conducting horn having an inner wall; and a first dielectric layer lining substantially the entire inner wall of the conducting horn, wherein the first dielectric layer comprises a metamaterial having a dielectric constant of greater than 0 and less than 1.

2. The horn antenna of claim 1, further comprising:

a dielectric core abutting at least a portion of the first dielectric layer, the dielectric core comprising a fluid.

3. The horn antenna of claim 2, wherein the dielectric core comprises a higher dielectric constant than the first dielectric layer.

4. The horn antenna of clam 1, wherein the first dielectric layer further comprises an impedance matching layer near an aperture of the conducting horn.

5. The horn antenna of claim 1, further comprising:

an impedance matched horn throat defined by at least a portion of the first dielectric layer.

6. The horn antenna of claim 1, further comprising:

a second dielectric layer disposed over at least a portion of the first dielectric layer.

7. The horn antenna of claim 6, further comprising:

a dielectric core abutting at least a portion of the second dielectric layer, the dielectric core comprising a fluid.

8. The horn antenna of claim 7, wherein the second dielectric layer comprises a higher dielectric constant than the dielectric core, and the dielectric core comprises a higher dielectric constant than the first dielectric layer.

9. The horn antenna of claim 6, wherein the first and second dielectric layers further comprise an impedance matching layer near an aperture of the conducting horn.

10. The horn antenna of claim 6, further comprising:

an impedance matched horn throat defined by at least a portion of the first and second dielectric layers.

11. A waveguide comprising:

an outer surface defining a waveguide cavity;

an inner surface positioned within the waveguide cavity; and a first dielectric layer lining substantially the entire inner surface of the waveguide cavity, wherein the first dielectric layer comprises a metamaterial having a dielectric constant of greater than 0 and less than 1.

12. The waveguide of claim 11, wherein the inner surface of the waveguide comprises a second dielectric layer, the second dielectric layer having a higher dielectric constant than the first dielectric layer.

13. The waveguide of claim 11, further comprising:

a first aperture configured to receive a radio frequency signal; and a second aperture configured to transmit the radio frequency signal;

wherein the waveguide cavity is disposed between the first and second apertures.

14. The waveguide of claim 13, wherein the portion of the waveguide surrounding the first aperture is tapered so that the waveguide cavity decreases in size as it approaches the first aperture, enabling the first aperture to operate as a power divider.

15. The waveguide of claim 13, wherein the portion of the waveguide surrounding the second aperture is tapered so that the waveguide cavity decreases in size as it approaches the second aperture, enabling the second aperture to operate as a power combiner.

16. The waveguide of claim 11, further comprising:

a plurality of power amplifiers disposed within the waveguide cavity, the plurality of power amplifiers arranged parallel to each other, the plurality of power amplifiers arranged substantially perpendicular to the inner surface of the waveguide cavity, wherein the plurality of power amplifiers are configured to amplify a radio frequency signal.

17. The waveguide of claim 11, wherein the waveguide cavity comprises a fluid.

18. A power combiner assembly comprising:

a plurality of power amplifiers; and a conducting horn having an inner wall, the conducting horn comprising a dielectric layer lining substantially the entire inner wall of the conducting horn, the dielectric layer including a metamaterial having a dielectric constant of greater than 0 and less than 1;

wherein the plurality of power amplifiers are configured to provide power to the conducting horn and wherein the conducting horn is configured to combine the power from the plurality of power amplifiers into a single power transmission.

19. The power combiner assembly of claim 18, further comprising:

a plurality of micro strip antenna elements, wherein at least one microstrip antenna element is associated with each of the plurality of power amplifiers, and wherein the plurality of microstrip antenna elements are configured to provide power from the plurality of power amplifiers to the conducting horn.

20. A reflector antenna comprising the power combiner assembly of claim 18, the reflector antenna further comprising:

a reflective dish, wherein the conducting horn is configured to direct the single power transmission towards the reflective dish.

* * * * *